United States Patent [19]

Kasahara et al.

[11] 4,200,475

[45] Apr. 29, 1980

[54] PROCESS FOR DYEING ALUMINUM-CONTAINING ZINC-BASED ALLOYS

[75] Inventors: Nobuyoshi Kasahara, Sayama; Koutaro Nonumura, Kunitachi, both of Japan

[73] Assignee: Mitsui Mining & Smelting Co., Ltd., Tokyo, Japan

[21] Appl. No.: 945,996

[22] Filed: Sep. 26, 1978

[51] Int. Cl.[2] ..... C23F 7/26; C23F 5/04

[52] U.S. Cl. ..... 148/6.1; 148/6.2

[58] Field of Search ..... 148/6.1, 6.2

[56] References Cited

U.S. PATENT DOCUMENTS 2,477,310 7/1949 McLean et al. ..... 148/6.1

3,405,014 10/1968 Kuwabara et al. ..... 148/6.1

FOREIGN PATENT DOCUMENTS 49-16635 2/1974 Japan ..... 148/6.2

*Primary Examiner*—Ralph S. Kendall

*Attorney, Agent, or Firm*—Frank J. Jordan

[57] ABSTRACT

A process for dyeing an aluminum-containing zinc-based alloy, which comprises immersing an aluminum-containing zinc-based alloy in an alkaline solution containing hexavalent chromium ion, further immersing the thus treated alloy in an acidic aqueous solution and then dyeing the thus further treated alloy in an aqueous solution of an organic dyestuff thereby to obtain a dyed aluminum-containing zinc-based alloy having decorative appearance and corrosion resistance.

3 Claims, No Drawings

PROCESS FOR DYEING ALUMINUM-CONTAINING ZINC-BASED ALLOYS

The present invention relates to a method which comprises chemically forming an anticorrosive layer on an aluminum-containing zinc-based alloy and dyeing said layer with an organic dye.

The present invention has its object to treat the surface of a zinc-based alloy containing 1-50 wt.% of aluminum. The present invention is particularly effectively applicable to the surface treatment of, for example, a zinc-based die cast alloy (such as described in JIS-H-5301) containing about 4 wt.% of aluminum or zinc spray coated or galvanized steel in which the zinc layer contains at least 1 wt.% of aluminum. The present invention is also particularly effectively applicable to the surface treatment of, for example, zinc-based alloys (containing 12 wt.% of aluminum) for gravity molding and superplastic zinc-based alloys containing 22-50 wt.% of aluminum. The superplastic zinc-based alloys, among others, may be vacuum or blow molded without loss of their metallic properties since they have thermoplasticity as thermoplastic resins and may be used in the field where decorative appearances are regarded as important; they may therefore be used as containers for appliance components and architectural decoration. As may be understood from the difference in specific gravity between aluminum and zinc, these alloys have a remarkably high voluminal content of aluminum and, therefore, conventional methods for the surface treatment of zinc are hardly applicable to the surface treatment of the alloys. For example, if a known method for plating zinc die cast be applied to the alloys, there will not be obtained plated products to which the plate adheres satisfactorily because of the formation of an aluminum oxide film on the alloys; in addition, if they be coated with a coating material, then securely coated product will not be obtained for the same reason as above. On the other hand, if the alloys be attempted to be surface treated under ordinary conditions by an anodizing method known as an aluminum surface treating method, there will not be obtained products having thereon an anodized or anodic oxidation film which is uniform, corrosion resistant and dyeable, due to the coexistence of the zinc in the alloys. Further, if a method for chemically dyeing zinc as disclosed by Japanese Patent Publications Nos. 4323/65 and 18728/67 be applied to the surface treatment of highly aluminum-containing alloys, no satisfactory results will be obtained. Thus, an excellent method for surface treating aluminum-containing zinc-based alloys has earnestly been sought for.

The present invention has been achieved to eliminate such disadvantages and will be detailed hereinbelow.

The method of the present invention comprises immersing an aluminum-containing zinc-based alloy with an aluminum content of 1-50 wt.%, after degreasing and/or polishing if necessary, in a strongly alkaline aqueous solution containing hexavalent chromium ion as a pretreatment solution, water rinsing the alloy so immersed, immersing the rinsed alloy in a preparatory solution containing hexavalent chromium ion and suitable anion in preparation for dyeing the alloy, water rinsing the pretreated alloy, and further immersing the rinsed pretreated alloy in a solution of an organic dyestuff thereby to obtain an aluminum-containing zinc-based alloy having its entire surface dyed and being provided with corrosion resistance.

The said pretreatment solution is required to have a pH value of 8 or higher, preferably 11 or higher, and contains as the main alkalizing sources alkali metal compounds such as sodium hydroxide, alkali earth metal compounds or mixtures thereof. The hexavalent chromium compound used in the pretreatment solution includes sodium bichromate or chromic acid anhydride and is employed in a concentration of 1-200 g/l, preferably 5-100 g/l, calculated as $Cr^{+6}$. The temperature for the pretreatment may vary from room temperature to the boiling temperature of the solution, preferably 40° C. to said boiling temperature, and the feasible treatment time is from 10 seconds to 5 minutes. Although the effect of said pretreatment has not fully been clarified, it is presumed that said solution reacts selectively with the aluminum in the surface of the alloy to convert it into a porous and somewhat dyeable aluminum oxide layer.

The preptreated alloy is soon water rinsed and then (within 60 minutes, preferably 5 minutes, including the water rinsing time after the pretreatment) immersed in the preparatory solution in preparation for dyeing the alloy. The preparatory solution may be any one which has a pH value of preferably 0.5 to 3.5 and contains hexavalent chromium ion and suitable additives mainly comprising as the anion source sulfuric acid, nitric acid, hydrochloric acid or salts thereof, as disclosed by the Japanese Patent Publications 64/62, 9558/61, 4323/65, 18728/67 etc. The treatment with the preparatory solution may be conducted under almost the same conditions as the aforementioned pretreatment with the alkaline solution; more particularly, the pretreatment or immersion may be continued at about 10° to 40° C. for 5 seconds to 3 minutes preferably with air agitation. This preparatory treatment is considered to have such effects on the zinc component in the alloy that the surface of the zinc component is converted to a porous, dyeable and corrosion resistant chromium-zinc compound. According to the present invention, the starting alloy allows a satisfactory chromium-zinc film to be formed thereon by effecting the preparatory treatment with the acidic solution soon after completion of the pretreatment with the alkaline solution, thereby to improve the resulting acid-treated surface of the alloy in dyeability, corrosion resistance and color tone. After said treatment with chromic acid, the alloy is thoroughly rinsed with water and then immersed in a solution of an organic dye such as an acid dye or a mordant dye for 0.5 to 10 minutes thereby realizing uniform dyeing over the entire surface of the alloy. This dyeing operation can be conducted under conditions similar to those for ordinary zinc dyeing.

As explained in the foregoing, the present invention is significant in having established a method for surface treating zinc-based alloys having a high aluminum content, to which alloys the conventional methods for surface treatmenting zinc or aluminum alone are hardly applicable, and in facilitating to provide the alloy not only with corrosion resistance due to chromate layer formation, but also with decorative appearance due to dyeing. Further a clear coating may be applied to the dyed alloy if necessary to improve the wear resistance thereof, and in this case a satisfactory of the clear coating to the organic dye layer is already confirmed.

Now the present invention will be further clarified by the following examples.

EXAMPLE 1

A molded article composed of an ILZRO 12 alloy (a gravity molding, zinc-based alloy containing 12 wt.% of aluminum) was immersed as a pretreatment in an aqueous solution containing 80 g/l. of sodium hydroxide and 30 g/l. of sodium bichromate at 60° C. for 2 minutes, water rinsed and then immersed in a chromate treating solution for dyeing, containing 10 g/l. of potassium bichromate, 60 g/l. of nitric acid and 10 g/l. of cobalt sulfate (as disclosed by Japanese Patent Publication 4323/65), for 25 seconds at 30° C., and, after thorough water washing, immersed in an aqueous solution of 3 g/l of alizarin red for 1 minute at 45° C., water rinsed and then dried thereby to obtain the article the entire surface of which was dyed in uniform deep red. The article so dyed was subjected to a salt spray test in accordance with JIS Z 2371 with the result that no rust was observed before the lapse of time of 48 hours after the start of the test.

For comparison, the procedure of Example 1 was followed except that the pretreatment with the alkaline solution was omitted, with the result the article was only partially dyed on about 10% of the entire surface area. The comparative partially dyed article was inferior in corrosion resistance and it was corroded in 24 hours when subjected to a salt spray test.

EXAMPLE 2

A molded article of superplastic zinc-based alloy (a zinc-based alloy composed principally of 22% of Al and 78% of zinc) was immersed, after ordinary degreasing, in a mixed aqueous solution containing 30 g/l. of sodium carbonate, 20 g/l. of sodium hydroxide and 50 g/l. of chromic anhydride at 80° C. for 1 minute as the pretreatment, rinsed with water, immersed in a chromate treatment solution in preparation for dyeing (disclosed in the Japanese Patent Publication 9558/61), containing 120 g/l. of chromic anhydride, 10 g/l. of potassium alum and 5 g/l. of zinc oxide, for 20 seconds at 18° C., thoroughly rinsed with water, immersed in an aqueous solution containing 5 g/l. of alizarin yellow GG for 3 minutes at 50° C., water rinsed and then dried whereby the article was uniformly dyed yellow on the entire surface. The article so dyed was subjected to a salt spray test with the result that it did not corrode until 60 hours passed after the start of the test. On the other hand, for comparison, the same procedure as above was followed except that the pretreatment was omitted, with the result that the article was hardly dyed and it did not rust until 16 hours passed after the start of a salt spray test when subjected thereto.

EXAMPLE 3

A molded article of a superplastic zinc-based alloy (containing 30% of Al, 70% of Zn, 0.5% of Cu and 0.01% of Mg) was immersed, after ordinary bright polishing, in an aqueous solution containing 100 g/l. of potassium hydroxide and 50 g/l. of potassium bichromate at 70° C. for 3 minutes as the pretreatment, water washed, immersed in a chromate treatment solution in preparation for dyeing (as disclosed in the Japanese Patent Publication 18728/67) containing 100 g/l. of chromic anhydride, 10 g/l. of ammonium chloride and 30 g/l. of zinc sulfate at 35° C. for 10 seconds, thoroughly rinsed with water, immersed in an aqueous solution containing 10 g/l. of anthracene blue SWGG for 3 minutes, water rinsed and then dried, whereby the article was uniformly dyed in lustrous blue on the entire surface. Further, the article so dyed was subjected to a salt spray test and, as the result, it did not rust until 100 hours passed after the start of the test and showed excellent corrosion resistance. Still further, the dyed article was coated with a polyurethane type clear resin curable at ambient temperature and then subjected to a cross-cut (adhesive) tape test (in accordance with JIS (Japanese Industrial Standard) D 202) for adhesion of the coating to the dyed article with the result that the coated dyed article showed excellent coating adhesion without any peeling of the coating. For comparison, the procedure of Example 3 was followed except that the pretreatment with the alkaline solution was omitted, thereby to obtain a product which showed hardly trace of reaction (chromate treatment) and no dyeability. Further, the product so obtained was coated with the same resin as above and then subjected to the same cross-cut tape test as above, with the result that about 10% of the coating of the coated product was peeled.

What is claimed is:

1. A process for dyeing an aluminum-containing zinc based alloy containing from 12 to 30 weight % of aluminum, comprising the steps of:

immersing said aluminum-containing zinc-based alloy in an alkaline aqueous solution containing hexavalent chromium ion, further immersing the thus treated alloy in an acidic aqueous solution containing hexavalent chromium ion and then dyeing the thus further treated alloy in an aqueous solution of an organic dyestuff thereby to obtain a dyed aluminum-containing zinc-based alloy having decorative appearance and corrosion resistance.

2. A process according to claim 1, wherein said alkaline aqueous solution contains 1–200 g/l of hexavalent chromium ion and has a pH value of at least 8.

3. A process according to claim 1, wherein said acidic aqueous solution contains 1–200 g/l of hexavalent chromium ion and has a pH value of not more than 3.5.

* * * * *